US010533550B2

(12) United States Patent
Klippert et al.

(10) Patent No.: US 10,533,550 B2
(45) Date of Patent: Jan. 14, 2020

(54) ELECTRIC OIL PUMP, IN PARTICULAR FOR A MOTOR VEHICLE

(71) Applicant: Brose Fahrzeugteile GmbH & Co. Kommanditgesellschaft, Wuerzburg, Wuerzburg (DE)

(72) Inventors: Uwe Klippert, Oberaula (DE); Christoph Otto, Wiesenfeld (DE)

(73) Assignee: Brose Fahrzeugteile GmbH & Co. KG, Wuerzburg, Wuerzburg (DE)

( * ) Notice: Subject to any disclaimer, the term of this patent is extended or adjusted under 35 U.S.C. 154(b) by 228 days.

(21) Appl. No.: 15/626,829

(22) Filed: Jun. 19, 2017

(65) Prior Publication Data

US 2017/0284391 A1 Oct. 5, 2017

Related U.S. Application Data

(63) Continuation of application No. PCT/EP2015/079640, filed on Dec. 14, 2015.

(30) Foreign Application Priority Data

Dec. 17, 2014 (DE) ..... 10 2014 018 587
Feb. 25, 2015 (DE) ..... 10 2015 002 352

(51) Int. Cl.
*F04C 15/00* (2006.01)
*F04C 2/08* (2006.01)
*F04C 2/10* (2006.01)

(52) U.S. Cl.
CPC ..... *F04C 15/0026* (2013.01); *F04C 2/086* (2013.01); *F04C 2/10* (2013.01);
(Continued)

(58) Field of Classification Search
CPC ..... F04C 15/0026; F04C 2/086
See application file for complete search history.

(56) References Cited

U.S. PATENT DOCUMENTS 5,156,540 A 10/1992 Fernau et al.
6,234,775 B1 * 5/2001 Agner ..... F04C 15/0026 418/132

(Continued)

FOREIGN PATENT DOCUMENTS

CN 102245902 A 11/2011
CN 102338085 A 2/2012

(Continued)

OTHER PUBLICATIONS

International Preliminary Report on Patentability for PCT Application No. PCT/EP2015/079640 dated Jun. 29, 2017—English translation.

(Continued)

*Primary Examiner* — Mary Davis
(74) *Attorney, Agent, or Firm* — Muncy, Geissler, Olds & Lowe, P.C.

(57) ABSTRACT

An oil pump, in particular an electric or electromotive auxiliary pump for a motor vehicle, having a housing having an inlet on the admission side and an outlet on the pressure side, in addition to a pump rotor which is inserted in the housing such that it can rotate about an axis, and having at least one rotor part, a flexible housing component which is in the form of an elastic press plate and which extends over the cross-sectional surface of the pump rotor. The flexible pressure plate is maintained, in an advantageous manner, in the edge area of the second housing parts.

14 Claims, 3 Drawing Sheets

(52) U.S. Cl.
CPC .... *F04C 15/0046* (2013.01); *F04C 2230/602* (2013.01); *F04C 2240/30* (2013.01); *F04C 2270/17* (2013.01)

(56) References Cited

U.S. PATENT DOCUMENTS

| | | | | |
|---|---|---|---|---|
| 6,527,529 | B2 | 3/2003 | Bodzak et al. | |
| 6,599,111 | B2 * | 7/2003 | Ohtaki | F04C 2/3446 418/132 |
| 6,641,380 | B1 * | 11/2003 | Nied-Menninger | F04C 15/0038 418/104 |
| 2002/0021978 | A1 | 2/2002 | Bodzak et al. | |
| 2012/0244012 | A1 * | 9/2012 | Kigure | F04B 17/03 417/32 |
| 2014/0255235 | A1 * | 9/2014 | Duncan | F04C 15/0026 418/135 |

FOREIGN PATENT DOCUMENTS

| | | | | |
|---|---|---|---|---|
| CN | 102434454 | A | 5/2012 | |
| DE | 2532091 | A1 | 2/1977 | |
| DE | 28 19 718 | A1 | 11/1978 | |
| DE | 19528086 | A1 * | 2/1997 | F04C 15/0026 |
| DE | 10 2008 054 758 | A1 | 6/2010 | |
| EP | 0 464 261 | A1 | 1/1992 | |
| EP | 1 156 221 | A2 | 11/2001 | |
| GB | 1 538 537 | | 1/1979 | |

OTHER PUBLICATIONS

First Chinese Office Action dated May 4, 2018 issued by the Chinese Patent Office in corresponding application 201580068866.9.

* cited by examiner

ELECTRIC OIL PUMP, IN PARTICULAR FOR A MOTOR VEHICLE

This nonprovisional application is a continuation of International Application No. PCT/EP2015/079640, which was filed on Dec. 14, 2015, and which claims priority to German Patent Application No. 10 2014 018 587.7, which was filed in Germany on Dec. 17, 2014, and German Patent Application No. 10 2015 002 352.7, which was filed in Germany on Feb. 25, 2015, and which are all herein incorporated by reference.

BACKGROUND OF THE INVENTION

Field of the Invention

The present invention applies to the field of oil pumps, preferably the field of electric or electromotor-operated or driven oil pumps, and relates to an oil pump with a housing having an inlet on the suction side and an outlet on the pressure side, and with a pump rotor which is inserted in said housing such that it is rotatable about an axis and has at least one rotor part. An oil pump here is, in particular, an auxiliary or supplemental pump in a or for a motor vehicle.

Description of the Background Art

An electric oil pump and, in particular, also a so-called auxiliary or supplementary pump, is used to convey oil as a lubricant for particularly moving parts or components, for example, of a vehicle (motor vehicle) which is powered by a combustion engine, hybridly or electrically. Owing to its conveying characteristics, such an oil pump usually produces an oil circuit, for example, with an oil sump for absorbing excess oil and/or leakage oil. An auxiliary or supplementary pump driven, for example, electrically or by an electromotor, frequently serves for at least temporary lubrication or additional lubrication of transmission parts of a vehicle transmission, in particular of an automatic transmission. In this case, the oil conveyed frequently also serves to cool components or additional components of the drive train of such a vehicle.

Such oil pumps are designed or constructed for relatively large temperature ranges. The temperature range or range to be controlled or considered is typically between, for example, −40° C. and 130° C. To bear in mind here is also that the lubricant (oil) used has a certain or specific viscosity, which is temperature-dependent and decreases with increasing temperature, that is to say, which is greater at lower temperatures than at higher temperatures.

Particularly at higher operating temperatures, or at rising temperatures due to operational reasons, the risk of leakage increases. The reason for this is that on the one hand, the avoidance of leakage is contingent on a correspondingly tight pump housing. On the other hand, because of the high temperature fluctuations, housing expansions, that is to say differing expansions of the pump housing and/or the relevant pump parts, tend to increasingly lead to leakages at increasing temperatures and thus decreasing viscosity of the oil or lubricant used, wherein said leakages exhibit a less significant tendency at low temperatures and, consequently, high viscosity of the oil or lubricant.

The pump rotor in the form of ordinarily used rotor or gear sets for oil pumps, which also include rotary slide or vane cell pumps as positive displacement pumps, are therefore usually manufactured exactly. There are typically no compensating measures, or these are not considered. In addition, pressure compensating pistons (GPM) or material combinations are frequently used, which mutually compensate each other for their thermal linear expansion.

Previous rotor or gear sets as pump parts for oil pumps are usually mounted in an aluminum pressure housing. In this case, the cast parts of the housing and the rotor sets are typically mechanically reworked or machined. Here, all individual parts must be manufactured as accurately (exact) as possible in their tolerances. In addition, it must be borne in mind that over virtually the entire, dimensioned temperature range, a clamping of moving, in particular rotating, parts of the oil pump is prevented, i.e., they are not allowed to clamp to other parts by striking or rubbing. On the other hand, the tolerances and/or the structural mechanical play of the, or of special, pump parts due to the undesired leakage losses should not be too great, that is to say, should be as small as possible.

If aluminum is chosen in a material combination for the pump housing and steel is selected for the pump impeller or impellers, it should be borne in mind that these two different materials expand (extend) in a thermally non-uniform, in particular differing, manner. This often leads to the fact that with increasing temperature (oil or lubricant temperature), leakage losses increase.

Pump types frequently used for such purposes are, for example, positive displacement pumps (external gear pumps), crescent pumps or vane cell pumps. A relatively inexpensive and in this case comparatively pulsation-free type of pump is an oil or auxiliary oil pump with a so-called gerotor (G-rotor pump). Such an oil pump has a rotor set (gear set) with an internally toothed outer ring (external gear ring) and an externally toothed inner rotor (internal gear ring).

SUMMARY OF THE INVENTION

It is therefore an object of the present invention is to provide an oil pump which can be driven by an electromotor and which is particularly suitable in terms of leakage losses as low as possible, which can preferably be produced as cost-effectively as possible.

The oil pump according to an exemplary embodiment of the invention has a housing with an inlet (suction port, suction nozzle, intake) and with an outlet (pressure port, pressure nozzle, discharge) and a pump rotor, which is preferably designed as a gerotor (G-rotor) with two gears or toothed rings, of which suitably one toothed wheel or toothed ring is driven. A flexible housing component in the form of a resilient side plate or diaphragm is arranged within the housing. This flexible housing component, preferably made of plastic, extends over the cross-sectional surface of the pump rotor.

The pump drive, i.e., the drive of the pump rotor, is preferably actuated electrically, i.e., by an electromotor, by means of a preferably brushless direct current motor. For this purpose, the driven gear wheel, preferably the internal gear ring of the gerotor, is preferably seated on a shaft which is coupled to the motor shaft of an electric motor, or is a component (shaft section) thereof.

In an embodiment, a side plate or a cover of a pump housing of an oil pump should not be rigid, but elastic or flexible. The housing component, which is hereinafter referred to as a flexible or elastic pressure plate, is preferably connected to the pressure side of the pump. Within the pump, only a comparatively small area is exposed to the pressure (pump pressure). Since the plate surface is considerably larger from or on the outside, this elastic pressure plate is pushed (pressed) against the pump rotor or gear set during pump operation by feeding a portion of the conveyed medium (oil) to the outside.

The flexible (elastic) pressure plate can be a housing or pump component which operates in the manner of a diaphragm or is designed as such and is formed, for example, of steel or plastic. This diaphragm (elastic pressure plate) is preferably provided in addition to a cover-like housing part (housing cover) and, in the area of the opening edge of the pump housing, in particular of a housing base body (shell-shaped housing part) made as a steel pot or an aluminum basic body, is preferably attached at the edge and held fixedly and as far as possible, sealingly, by means of the housing cover in or on the pump housing.

A space (clearance, pressure chamber) can be formed on the outer side of the flexible pressure plate or diaphragm located opposite the housing interior for accommodating the pump impeller (gear set), into which oil conveyed by means of the pump can be introduced or is introduced. The corresponding oil pressure of the oil introduced into said space presses the pressure plate (diaphragm) against the oil pressure acting from the inside (internal oil pressure). In doing so, for example, a desired equilibrium or at least a certain pressure equalization is established.

This aspect of the invention is based on the realization that, when using a flexible (elastic) pressure plate, said plate expands as the oil temperature rises, just as the oil viscosity decreases or drops with increasing temperature. This results in a virtually automatic adjustment of the axial stroke of the pressure plate. This then balances the housing extension and the pressure plate so that leakage losses can be reduced, minimized or even completely prevented.

In this way, on the one hand, the high requirements for the production tolerances can be reduced, and on the other hand, leakage losses can be reduced even with low oil viscosity. Moreover, the production of the oil pump is simple and inexpensive. Furthermore, comparatively high efficiencies, in particular, greater than 60%, can be achieved without the oil pump having to be oversized.

In an embodiment, the pressure chamber provided on the outer side of the flexible pressure plate opposite the pump rotor is connected to the outlet side of the pumps, i.e., to the pressure side thereof. The pressure chamber formed in the axial direction between the flexible pressure plate and the housing cover expediently extends in the radial direction between an annular circumferential projection and an opening collar of the flexible pressure plate which is directed toward the pump rotor. A fluid channel opening into the pressure chamber can be inserted into the housing for a small partial flow of the conveyed medium.

According to an embodiment, a suitably movably mounted and, in particular, rigid side plate is arranged between the flexible pressure plate and the pump rotor, with a passage opening which is suitably circular-arc-shaped and which is aligned with the outlet on the pressure side. In addition, the flexible pressure plate preferably has a bead-like formation which is open towards the pump rotor and at least partially overlaps the passage opening provided in the side plate.

The pump housing can have a sleeve-like shaft feedthrough with a bearing sleeve disposed therein for the bearing and passage of a motor shaft of an electric motor to the pump rotor, and on the side of the pump rotor opposite the shaft feedthrough, a shaft receiver with a bearing sleeve for supporting the motor shaft. The outlet on the pressure side is expediently inserted into the housing on the cover side, and the inlet on the suction side is inserted on the bottom side of the housing base body.

If the flexible pressure plate is made of steel, a supporting factor can be established by the sheet thickness of the pressure plate and/or by certain accommodation zones. If the pressure plate is produced from plastic, further design levels are particularly obtained in that the pressure plate, for example, has different heights at different points. In addition, as is known, the stiffness of the plastic decreases with increasing temperature. At the same time, the viscosity of the oil decreases with increasing temperature. As a result, a plastic plate as a pressure plate can ideally compensate for leakage at higher temperatures.

Overall, the leakage losses of the oil pump can thus be significantly reduced by means of this principle. In addition, efficiency increases and the electrical components can be dimensioned smaller. Furthermore, tolerances from the production of the individual parts and assembly can be compensated for. The pump parts must therefore preferably be produced less precisely. Furthermore, different coefficients of expansion of the or of individual pump parts can be disregarded.

A further advantage is that, with increasing pump pressure, the leakage gaps become smaller, that is to say, they particularly do not become larger due to operational reasons. A further advantage is that by selecting the material and design of the elastic pressure plate, the desired target variables can be set particularly reliably and/or simply.

In the design of the pressure plate made of plastic, the low viscosity of the oil can also be compensated at higher temperatures. If the cover-like housing part (housing cover, side plate) is designed without initial basic pressing, the inserted electric motor can start in a simple manner without a sensor. The oil pump designed in such a way can also have one or two additional elastic side plates or individual parts which can be acted on by the output pressure of the pump.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
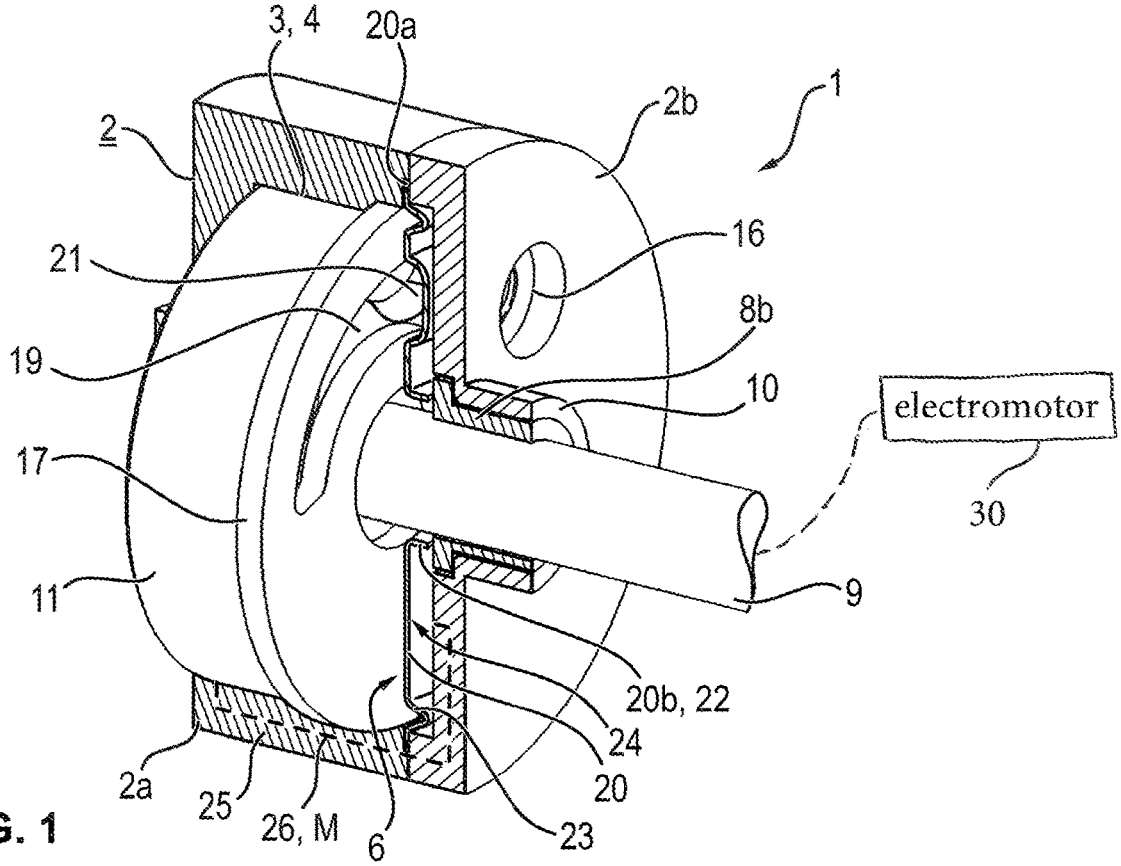
FIG. 1 is a perspective pressure-side view of an electrical or electromotor-driven oil pump having a housing shown in partial section and partially transparent, having therein a fixed side plate between an elastic pressure plate (diaphragm) and a gear set as a pump rotor (G-rotor)
Figure 2:
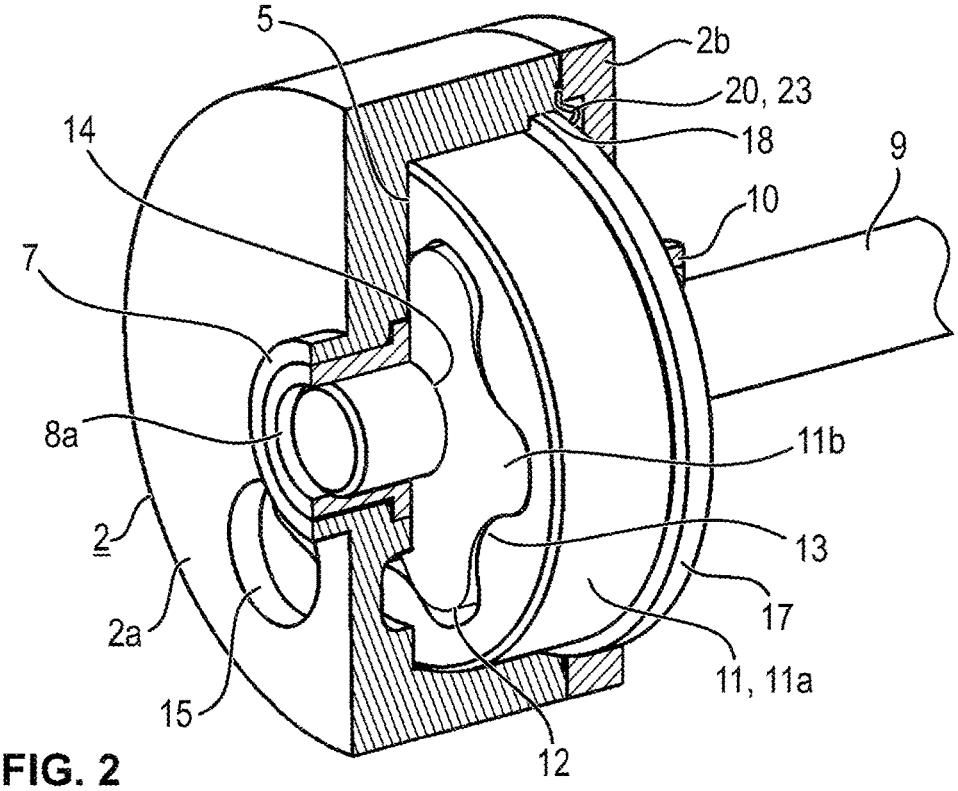
FIG. 2 is a representation according to FIG. 1, of the oil pump in a perspective suction-side view, with a view to the gear set (G-rotor)
Figure 3:
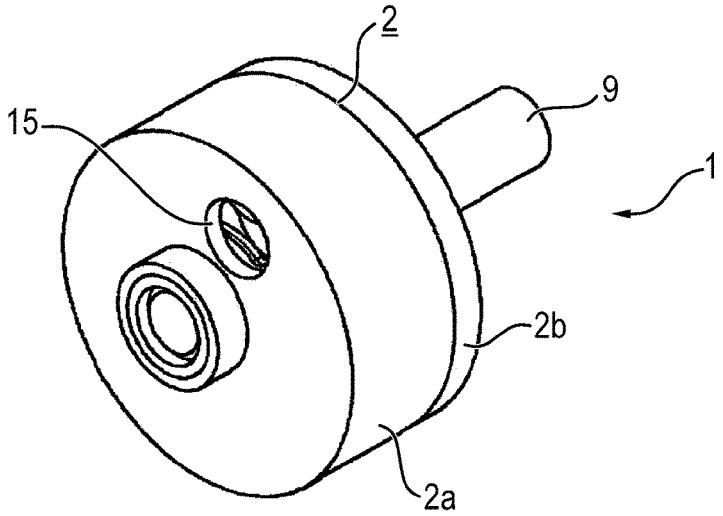
FIGS. 3 and 4 illustrate the oil pump in a perspective view, with a view to a suction opening (inlet) on the housing bottom side or to a shaft-side pressure opening (outlet)
Figure 4:
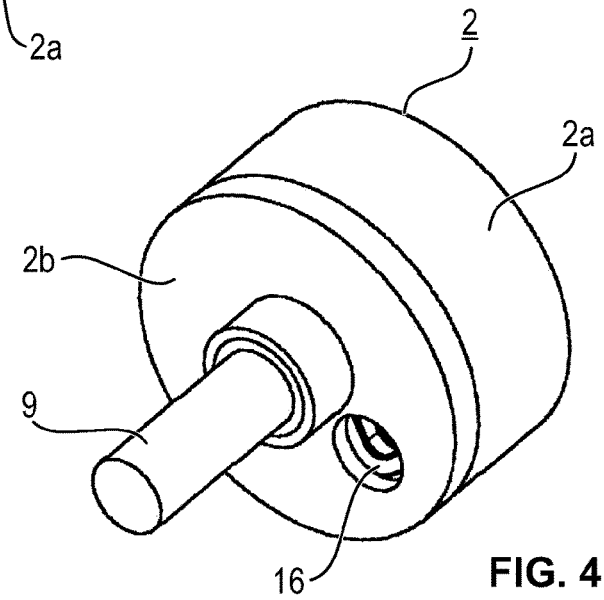

According to FIGS. 1 to 4, the oil pump 1 has a pump housing 2 formed, for example, of steel or aluminum, in the form of a shell-like (first) housing part, which is subsequently referred to as the housing base body 2*a*, and a cover-like housing part, hereinafter referred to as housing cover 2*b*. The housing base body 2*a* forms a cylindrical housing wall 3, that is to say, in particular, a cylindrical interior space 4 and a housing base 5, which is hereinafter also referred to as a first side plate, as well as a housing opening 6 axially opposite it. A bottom-side bearing opening 7, which is extended in the manner of a collar, serves in conjunction with a bearing sleeve 8*a* seated therein for the sliding bearing of a motor shaft 9 of an electric motor (see electromotor 30 in FIG. 1). A corresponding sleeve-like shaft feedthrough 10 with a bearing sleeve 8*b*, which in turn is seated therein, in the housing cover 2*b* serves for the passage of the motor shaft 9 from the outside into the housing 2 and there via a pump rotor 11 into the bearing opening 7.

Figure 5:
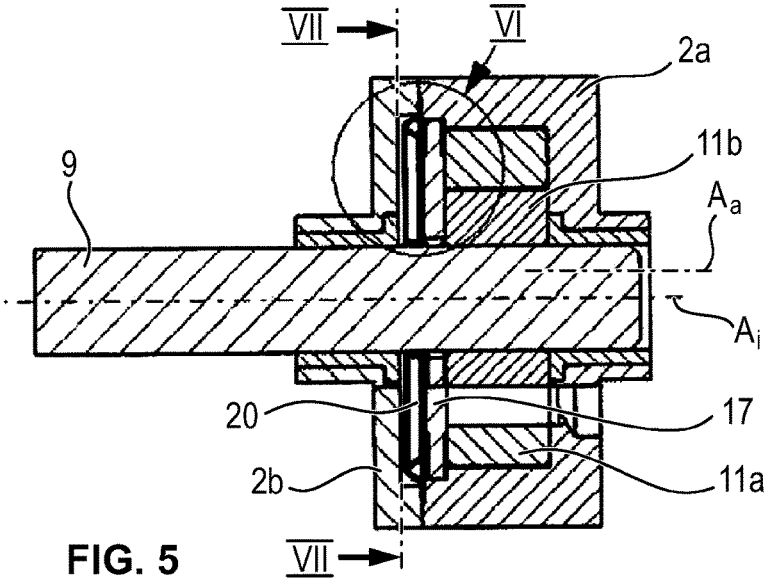
FIG. 5 is an axial sectional view of the oil pump.

In connection with FIG. 5, it can be seen that a gear set with an internally toothed external gear ring 11*a* and with an externally toothed internal gear ring 11*b* is inserted as a pump rotor 11 into the housing interior 4 of the housing base body 2*a*. In each rotational position relative to the external toothed ring 11*a*, the external toothing 12 of the internal gear ring 11*b* is partially intermeshed between or in the internal toothing 13 of the former. Some of the wavy teeth of the external toothing 12 are thereby inserted in the again wavy tooth gaps of the internal toothing 13 of the external gear ring 11*a* and vice versa, while other teeth of the external toothing 12 of the internal gear ring 11*b* can slide along a peripheral portion of the internal toothing 13 of the external gear ring 11*a* without tooth engagement. Such a gear set (11*a*, 11*b*) as a pump rotor 11 is also referred to as a gerotor (G-rotor).

As indicated in FIG. 5 by means of the dashed lines Ai and Aa, the axis $A_a$ is radially spaced apart (eccentric) from the central axis (center/symmetry axis) $A_i$, which forms the axis of rotation of the external gear ring 11*a*, as an axis of rotation of the internal gear ring 11*b*—and thus the shaft feedthrough 10—which internal gear ring is, for example, positively joined with the motor shaft 9. To receive the shaft 9, the internal gear ring 11*b* has a, for example, star-shaped contoured joining opening 14. The latter is aligned with the bearing opening 7 of the housing base body 2*a*.

In contrast to the external gear pump, in the case of such an internal gear ring or gear ring pump as a special type of gear pump, the internal gear ring 11*b* thus runs as a driving gear eccentrically in the external gear ring (outer toothed ring) 11*a*. In the case of this gear ring pump, the medium is conveyed between the tooth gaps of the gear rings 11*a* and 11*b* by the displacement space which is changing in the volume. In other words, in this gear pump, which is also referred to as a crescent pump, the medium to be conveyed is conveyed in the spaces between the tooth gaps of the two gear rings (gear wheels) 11*a* and 11*b*, wherein the teeth are sealed by the crescent between the inwardly directed inner teeth of the external gear ring 11*a* and the outwardly directed outer teeth of the internal gear ring 11*b*. In the case of the illustrated gear ring pump as oil pump 1, the external gear ring 11*a* has exactly one tooth more than the internal gear ring 11*b* (trochoid toothing).

The housing base body 2*a* is closed with the housing cover 2*b*. The pressure-side pump outlet (pressure opening or pressure outlet) 16 is provided in the housing cover 2*b* (FIGS. 3 and 4), while the suction-side pump inlet (suction openings) 15 is introduced into the housing bottom 5 of the housing base body 2*a*.

Within the housing 2, a side plate 17, which is penetrated by the motor shaft 9, is fixed to the edge side of the housing opening 6 of the housing base body 2*a*. This, preferably rigid, side plate 17 is located on the edge or outer circumference in an annular notch 18 of the housing base body 2*a*. The rigid side plate 17 has a circular-arc-shaped passage opening 19 extending over a circumferential section. Between this side plate 17 and the housing cover 2*b*, a flexible pressure plate 20, hereinafter also referred to as a diaphragm, is inserted into the housing 2. This preferably circular pressure plate 20 is clamped with its outer edge 20*a* between the housing base body 2*a* and the housing cover 2*b* on the opening or edge side and is therefore also fixed to the housing. By means of the flexible pressure plate 20, in particular temperature-dependent partial expansions of housing or pump are reduced and/or compensated for.

Figure 7:
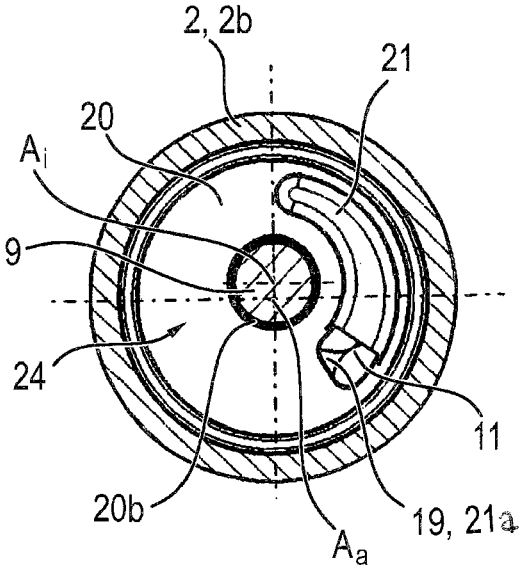
FIG. 7 is a sectional view along the line VII-VII in FIG. 5, with a view to the pressure side of the elastic pressure plate (diaphragm).

In the region of the passage opening 19 of the side plate 17, a bead-like, indented outlet channel 21 is formed into the flexible pressure plate 20, which outlet channel is aligned with the circular-arc-shaped passage opening 19 of the side plate 17 with respect to its shape and location (position), covering said side plate but leaving a passage 21*a* (FIG. 7). This passage 21*a* is aligned with the cover-side pump outlet 16 which can be seen in FIG. 4.

An opening collar 22, which is pulled out in the direction of the housing cover 2*b*, is formed or shaped in the region of the shaft feedthrough 10, i.e., aligned with the latter, into the pressure plate 20 at its shaft feedthrough 20*b*. In the region of the outer edge 20*a* or outer circumference of the flexible pressure plate 20, a bead-like, annular circumferential formation 23 is likewise inserted in the direction of the housing cover 2*b*. Between this formation 23 and the opening collar 22, a pressure chamber (clearance/pressure equalization chamber) 24 is formed. A fluid channel (housing channel) 26 to this pressure chamber 24, which is indicated by dashed lines, can be inserted into the housing wall 25 of the housing 2. A partial flow of the conveyed medium (oil) M from the inlet-side suction side can pass through said fluid channel, between the flexible pressure plate 20 and the housing cover 2*b*, into the pressure chamber 24.

Figure 6:
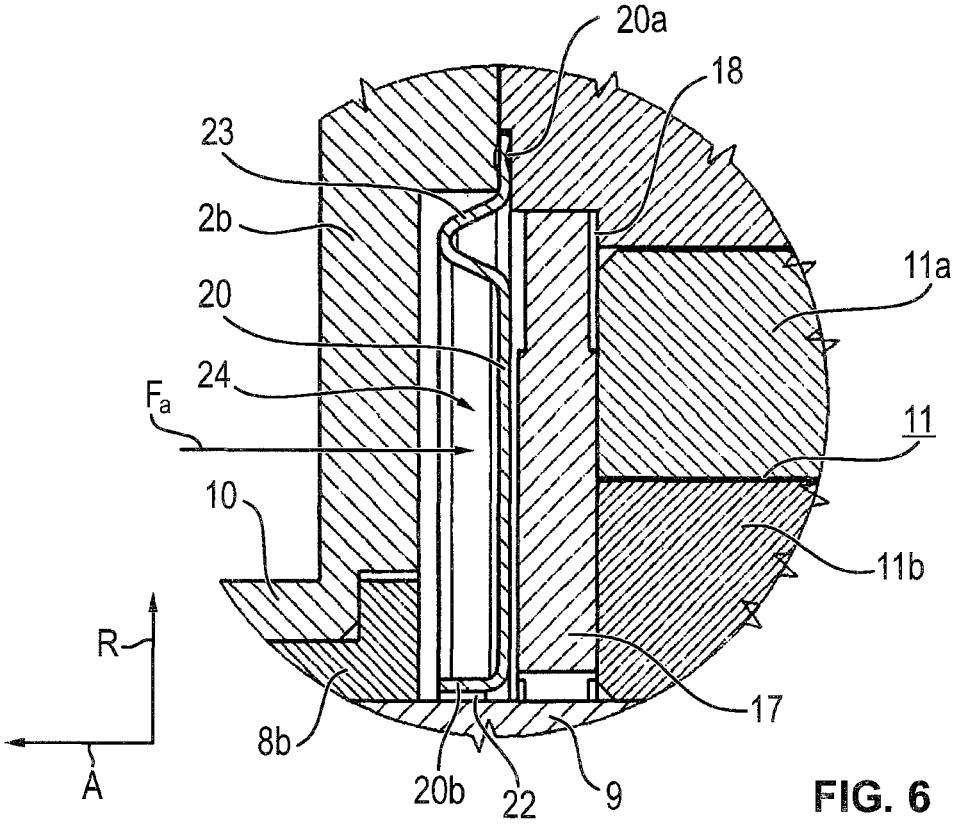
FIG. 6 is a section VI of FIG. 5 in a larger scale with a view to a peripheral rim of the pressure plate in the housing and to a pressure chamber between a shaft feedthrough and a circumferential bead contour.

In viewing the section shown in FIG. 6 and the cross-section in FIG. 7, the flexible pressure plate (diaphragm) 23 which extends transversely to the axial direction A of the oil pump 1 in the radial direction R and thus practically across the entire housing cross-sectional area, and the pressure chamber (clearance/pressure chamber, pressure equalization space) 24 formed between the diaphragm and the housing cover 2*b* can be seen. In these, oil M can be introduced via the fluid channel 26, i.e., a partial flow of the oil M conveyed through the pump 1. When the pump is operated, this results in a force action $F_a$ on the outer side of the flexible pressure plate 23 situated opposite the gear set 11*a*, 11*b*. This pressure force $F_a$ acts counter to the oil compressive force prevailing in the pump interior 4 and can thus produce at least some pressure equalization.

The invention is not limited to the embodiments described above. Rather, other variants of the invention can also be derived from those skilled in the art without departing from the scope of the invention. In particular, all the individual features described in connection with the exemplary embodiments can also be combined with one another in another manner without departing from the subject matter of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An oil pump comprising:

a housing having an inlet on a suction side and an outlet on a pressure side; and a pump rotor arranged in the housing such that the pump rotor is rotatable about an axis, the pump rotor including at least one rotor part;

a flexible housing component in the form of an elastic pressure plate that extends over a cross-sectional area of the pump rotor, the elastic pressure plate having an opening that is a shaft feedthrough and a motor shaft of an electromotor to the pump rotor that passes through the shaft feedthrough, and a movably mounted rigid side plate is arranged between the elastic pressure plate and the pump rotor;

wherein the housing has a first housing part as the housing base body, which accommodates the pump rotor, and a second housing part as the housing cover, wherein an outer edge of the elastic pressure plate is held and/or clamped between the housing base body and the housing cover, and wherein the housing cover has a sleeve-like shaft feedthrough with a bearing sleeve, which is disposed therein, for mounting and passage of the motor shaft of the electromotor to the pump rotor and wherein the housing base body has a shaft receiver with a bearing sleeve, which is disposed therein, for the mounting of the motor shaft.

2. The oil pump according to claim 1, wherein the elastic pressure plate has an inner side that faces the pump rotor and an outer side that opposes the inner side and faces away from the pump rotor, wherein a pressure chamber is provided on the outer side of the elastic pressure plate, and wherein the pressure chamber is in connection with the pressure side of the oil pump.

3. The oil pump according to claim 2, wherein, in an axial direction, the pressure chamber is formed between the elastic pressure plate and the housing cover of the housing, such that, in the axial direction, the pressure chamber is delimited by the outer side of the elastic pressure plate and an inner surface of the housing cover that faces the outer side of the elastic pressure plate.

4. The oil pump according to claim 1, wherein the movably mounted rigid side plate has a passage opening aligned with the outlet on the pressure side.

5. The oil pump according to claim 4, wherein the passage opening of the side plate is circular-arc shaped.

6. The oil pump according to claim 4, wherein the motor shaft passes through a central opening of the side plate.

7. The oil pump according to claim 4, wherein the outer edge of the elastic pressure plate is held and/or clamped between the housing base body and the housing cover, such that the outer edge directly contacts both the housing base body and the housing cover.

8. The oil pump according to claim 1, wherein the outlet on the pressure side is inserted into the housing cover and the inlet on the suction side is inserted into a bottom side of the housing base body.

9. The oil pump according to claim 1, wherein the pump rotor is a gear set with an internal gear ring eccentrically mounted in the housing and with an external gear ring accommodating the internal gear ring, which is centrally mounted in the housing.

10. The oil pump according to claim 1, wherein the oil pump is an electric or electromotor-driven auxiliary pump for a motor vehicle.

11. An oil pump comprising:

a housing having an inlet on a suction side and an outlet on a pressure side; and a pump rotor arranged in the housing such that the pump rotor is rotatable about an axis, the pump rotor including at least one rotor part; and a flexible housing component in the form of an elastic pressure plate that extends over a cross-sectional area of the pump rotor, the elastic pressure plate having an opening that is a shaft feedthrough and a motor shaft of an electromotor to the pump rotor passes through the shaft feedthrough, wherein a movably mounted rigid side plate having a passage opening aligned with the outlet on the pressure side is arranged between the elastic pressure plate and the pump rotor, and wherein the elastic pressure plate has a bead-like formation which is open towards the pump rotor and is aligned with the outlet on the pressure side or at least partially overlaps the passage opening provided in the side plate, and/or wherein the shaft feedthrough of the elastic pressure plate has an opening collar that is directed away from the pump rotor.

12. An oil pump comprising:

a housing having an inlet on a suction side and an outlet on a pressure side; and a pump rotor arranged in the housing such that the pump rotor is rotatable about an axis, the pump rotor including at least one rotor part; and a flexible housing component in the form of an elastic pressure plate that extends over a cross-sectional area of the pump rotor, the elastic pressure plate having an opening that is a shaft feedthrough and a motor shaft of an electromotor to the pump rotor passes through the shaft feedthrough, wherein in an area of an outer circumference of the elastic pressure plate, an annular, circumferential, bead-like formation is provided, which is open towards the pump rotor.

13. The oil pump according to claim 12, wherein the elastic pressure plate has an inner side that faces the pump rotor and an outer side that opposes the inner side and faces away from the pump rotor, wherein a pressure chamber is provided on the outer side of the elastic pressure plate, wherein the pressure chamber is in connection with the pressure side of the oil pump, wherein the shaft feedthrough of the elastic pressure plate has an opening collar that is directed away from the pump rotor, and wherein, in a radial direction, the pressure chamber extends between the annular, circumferential, bead-like formation and the opening collar of the elastic pressure plate.

14. An oil pump, the oil pump comprising:

a housing having a suction-side inlet and a pressure-side outlet;

a pump rotor arranged rotatably about an axis in the housing, the pump rotor having at least one rotor part;

an elastic pressure plate that extends over a cross-sectional area surface of the pump rotor, the elastic pressure plate having an opening that is a shaft feedthrough and a motor shaft of an electromotor to the pump rotor that passes through the shaft feedthrough; and a side plate arranged between the elastic pressure plate and the pump rotor having a passage opening that is aligned with the pressure-side outlet;

wherein the housing has a housing base body, which accommodates the pump rotor, and a housing cover, wherein an outer edge of the elastic pressure plate is held and/or clamped between the housing base body and the housing cover, and wherein the housing cover has a sleeve-like shaft feedthrough with a bearing sleeve, which is disposed therein, for mounting and passage of the motor shaft of the electromotor to the pump rotor and wherein the housing base body has a shaft receiver with a bearing sleeve, which is disposed therein, for the mounting of the motor shaft.

* * * * *